US005218976A

United States Patent [19]

Gutman

[11] Patent Number: 5,218,976

[45] Date of Patent: Jun. 15, 1993

[54] DEVICE TO PERFORATE PACKAGED CIGARETTES

[75] Inventor: Bernard Gutman, Rego Park, N.Y.

[73] Assignee: Products and Patents, Ltd., Lynbrook, N.Y.

[21] Appl. No.: 778,389

[22] Filed: Oct. 16, 1991

[51] Int. Cl.[5] ..... A24C 5/40; A24F 13/24

[52] U.S. Cl. ..... 131/281; 131/329; 131/188; 83/30

[58] Field of Search ..... 131/281, 328, 188, 329; 83/30

[56] References Cited

U.S. PATENT DOCUMENTS

| | | | |
|---|---|---|---|
| 925,158 | 6/1909 | Cragg . | |
| 3,405,718 | 10/1968 | Grassi . | |
| 4,046,152 | 9/1977 | Purdon . | |
| 4,148,324 | 4/1979 | Muller et al. | 131/281 |
| 4,231,378 | 11/1980 | Stevens . | |
| 4,246,912 | 1/1981 | Landuydt | 131/281 |
| 4,463,770 | 8/1984 | Thompson . | |

*Primary Examiner*—V. Millin
*Assistant Examiner*—J. Doyle
*Attorney, Agent, or Firm*—Bruce L. Adams; Van C. Wilks

[57] ABSTRACT

A device for perforating packaged cigarettes, or the like, including a first housing member provided for defining a receiving area having an opening for receiving a package of cigarettes. A plurality of piercing needles are provided which are moveable relative to the first housing member to pierce the cigarettes. A safety plate member is provided covering the opening of the receiving area. The safety plate member is effective at a first position to block the movement of the piercing needles into the receiving area and at a second position to allow the package of cigarettes into the receiving area. The safety plate member is supported by at least two spring members for biasing the safety plate member towards the first position. The spring members are positioned on a central longitudinal axis of the safety plate member and have spring properties effective to allow steady and smooth movement of the safety plate member. Spacer members are provided for altering the space defined by the receiving area to accommodate various sized cigarette packages. A switch including a switch protrusion guided by a straight guide groove is provided for selectively raising and lowering the package of cigarettes so as to create perforations at different locations on the cigarette. The switch protrusion may be locked at a first and second position and an improved switch pad is provided having grip enhancing raised ridges.

37 Claims, 8 Drawing Sheets

DEVICE TO PERFORATE PACKAGED CIGARETTES

BACKGROUND OF THE INVENTION

The present invention pertains to a device for perforating packaged cigarettes, or the like. In particular, the present invention pertains to a device for perforating packaged cigarettes which is simple to use, safe and efficient.

For many years, people have designed methods and devices to aid in breaking the physical addiction to tobacco smoking. For example, one method, commonly known as "going cold turkey", requires simply that the smoker suddenly stop smoking and refrain from smoking. However, this method is often a failure and after a short period of time the smoker usually will renew his habit, sometimes with more vigor. This is because cigarette smoking becomes a physical addiction in which the body craves the nicotine in the cigarette smoke. The smoker's body has become conditioned to accept the nicotine from the tobacco smoke as a necessary chemical and thus withdrawal from the smoking habit becomes physically very difficult.

Other methods and devices which are known require that the smoker slowly wean his body from the perceived nicotine requirement. With these methods and devices, the smoker continues the smoking habit during the period of weaning, however, the intake of nicotine from the tobacco smoke is systematically decreased. Thus, the smoker's body slowly becomes accustomed to less and less of the nicotine intake until the smoker can more easily stop smoking altogether.

A device is known for perforating packaged cigarettes. The cigarettes are perforated with a small pin-hole located near the junction between the filter and tobacco portions of the cigarette. The small pin-hole allows cool air to be drawn in while the smoker is drawing the hot tobacco smoke in through the cigarette. The mixture of hot and cool air creates condensation that traps tar, nicotine, carbon monoxide and other poisons. Thus, by perforating the cigarette in the manner described, the user is exposed to less nicotine per cigarette. To aid the smoker in his efforts to quit smoking, he may systematically increase the number of perforations in the cigarettes so that over time he is inhaling less and less nicotine per cigarette and may thus slowly wean his body from the perceived nicotine requirement.

Referring to FIGS. 5*a* through 5*h*, a prior art device 100 for perforating packaged cigarettes is shown. In this device, a receiving area 102 is provided in a first housing member 104. As shown in FIG. 5*d*, the receiving area 102 is configured to receive a package of U.S. domestically packaged cigarettes 106 (the cigarette package is omitted for clarity). The cigarette package is placed at the receiving area 102 so that the lip end of the package contacts with a safety plate 108 (shown in FIG. 5*c*) disposed in the opening of the receiving area 102. The safety plate 108 is omitted in FIG. 5(*a*). The cigarette package is inserted into the receiving area 102 so that the safety plate 108 is pushed rearwardly against a spring bias provided by springs 110 (shown in FIGS. 5*f* and 5*h*). The cigarette package is pushed against the safety plate 108 into the receiving area 102 until the safety plate 108 no longer can be depressed. At this position, the cigarettes 106 are located so that perforations can be formed therein by piercing means. The piercing means includes a plurality of needles 112 supported by a support 114 which is fixed to a second housing member 116. The second housing member 116 is slidable over the first housing member 104 and guided by the action of a projection 120 and slot 122 combination (shown in FIG. 5*b*). A pair of springs 118 is interposed between the first and second housing members 104,116 to bias them apart to expose the receiving area 102.

The piercing needles 112 are guided by guide holes 124 so that in operation, the user manually slides the second housing member 116 relative to the first housing member 104 so that the piercing needles 112 may pass through the guide holes 124 and perforate the cigarettes 106 contained in the receiving area 102. For safety, when the cigarette package is not contained in the receiving area 102, the safety plate 108 is disposed at a position which blocks the passage of the piercing needles 112 through the guide holes 124 even if one attempts to slide the second housing member 116 relative to the first housing member 104. Thus, by blocking the unwanted intrusion of the piercing needles 112 into the receiving area 102 at a time when there are no cigarettes disposed in the receiving area 102, the safety of the device is enhanced.

However, as shown in FIG. 5*a*, the springs 110 biasing the safety plate 108 are fixed to the base of the receiving area 102 by spring receptacles 126, which are located at positions which result in an unsteady movement of the safety plate 108 when it is depressed against the spring bias. In other words, the springs 110 are positioned offset from the horizontal center axis of the safety plate 108 and thus there is a tendency for the safety plate 108 to pivot when depressed, and because of the close fitting tolerances necessary between the safety plate 108 and the edges of the receiving area 102, binding occurs and the safety plate 108 often becomes stuck in the depressed condition. In the depressed condition, the safety plate 108 does not provide any means for blocking the passage of the piercing needles 112 through the guide holes 124 and thus the safety factor provided by the safety plate 108 is compromised. To further add to the instability of the movement of the safety plate 108, the diameter of the springs 110 used in this prior art device is sufficiently small that the safety plate 108 tends to wobble during depression, which hinders the use of the device, and which also results in the binding of the safety plate 108 against the edges of the receiving area 102, further resulting in loss of the safety feature.

In order to perforate the cigarettes 106 in a manner which allows multiple perforations to be applied to each cigarette 106, a means is provided for altering the position of the cigarettes 106 in the receiving area 102 relative to the piercing needles 112. Thus, the user will insert the cigarette package into the receiving area 102 and make a first perforation in the cigarettes and then remove the cigarette package. Next, the user will alter the position relative to the receiving area 102 that the safety plate 108 may be depressed, and then reinsert the cigarette package so that the lip ends of the cigarettes are at a different position relative to the piercing needles 112, and apply a second perforation in the cigarettes which is at a different position relative to the first perforation. The means provided in the prior art device includes a switch protrusion 128 disposed in and guided by an L-shaped switch slot 130 (shown in FIGS. 5*a* and 5*b*). In operation, the user places the switch protrusion 128 at a first position by moving the switch pad 132 (shown in FIG. 5*b*) to a first switch position. This first switch position corresponds with the position of the switch protrusion 128 shown in FIG. 5*h* in which the switch protrusion contacts the surface of a cutout 134 provided in one of the side walls of the safety plate 108 to thereby increase the maximum depth to which the safety plate 108 may be depressed by a thickness T as compared to the other switch position. To switch to the second switch position, the user moves the switch pad 132 laterally and downwardly through the L-shaped switch slot 130 so that the switch protrusion 128 is positioned at the location shown in FIG. 5*g*. At this second position, the switch protrusion 128 does not contact the cutout 134 and therefore the safety plate 108 may be depressed by an additional distance relative to the first switch position.

By switching the position of the switch protrusion 128, the location at which the perforation is applied to the cigarette 106 may therefore be altered so that multiple perforations may be applied to the cigarettes 106 to increase the reduction in the intake of nicotine and other harmful toxins in the tobbaco smoke and wean the smoker from nicotine dependency.

This prior art device has many drawbacks. In particular, the safety plate 108 is supported by the springs 110 in such a way that binding occurs during the depression of the safety plate 108 into the receiving area 102. Because the safety plate 108 has a tendency to wobble in this configuration, binding often occurs resulting in difficult operation of the device. When binding occurs at a position where the safety plate 108 no longer blocks the intrusion of the piercing needles 112 into the receiving area 102, the safety of the device is severely diminished.

Furthermore, the L-shaped switch slot 130 required by the prior art construction makes the device difficult to use and also does not provide any means for locking the switch protrusion 128 in either the first or second positions. This is disadvantageous because after repeated uses, the switch becomes loose and the switch protrusion 128 often will fall back into the undesired position thereby preventing multiple perforations of the cigarettes 106.

In addition, this prior art device provides absolutely no means by which a cigarette package which is larger than the standard U.S. cigarette package may be accommodated in the receiving area while still providing a means for adequately accommodating the standard U.S. package.

SUMMARY OF THE INVENTION

The present invention is intended to alleviate the aforementioned drawbacks of the prior art. In particular, one object of the present invention is to provide a device for perforating packaged cigarettes, or the like, in which a slidable safety plate member is supported by at least two spring members for biasing the safety plate member towards a first position to block the movement of piercing needles into a cigarette-receiving area, the spring members having spring properties effective to allow steady and smooth movement of the safety plate member.

A further object of the present invention is to provide a device for perforating packaged cigarettes in which the safety plate member may be smoothly depressed in the receiving area without the safety plate member binding against the sides of the receiving area.

Another object of the present invention is to provide a device for perforating packaged cigarettes, or the like, in which space altering means are provided for altering the space defined by the receiving area to accommodate cigarette packages of different sizes.

Still another object of the present invention is to provide a device for perforating packaged cigarettes, or the like, including switching means for selectively switching the depth to which the safety plate member may be depressed to allow multiple perforations of the cigarettes, the switching means having a straight guide groove for guiding a switch protrusion between first and second positions and locking means for locking the switch protrusion at the first and second positions.

In accordance with the present invention, the device comprises a first housing member for defining a receiving area having an opening for receiving a package of cigarettes into the receiving area. Piercing means including a plurality of needles are movable relative to the first housing member to pierce the cigarettes in the cigarette package. A safety plate member is disposed in the receiving area and positioned, configured and dimensioned to substantially cover the opening of the receiving area. The safety plate member is effective at a first position to block the movement of the piercing means and at a second position to allow insertion of the package of cigarettes into the receiving area and allow the piercing needles to pierce the cigarettes in the cigarette package.

Biasing means including at least two spring members are provided for biasing the safety plate member towards the first position. The spring members are positioned along the horizontal center line of the safety plate member and have spring properties effective to allow steady and smooth movement of the safety plate member between the first and second positions to thereby alleviate the binding and other drawbacks associated with the prior art.

Space altering means are provided including at least one spacer member which is disposable in the receiving area for altering the dimensions of the space defined by the receiving area to accommodate variously sized cigarette packages. The space altering means may include two spacer members each disposable in and slidably attachable at opposing sides of the receiving area. The opposed sides of the receiving area may each have at least one aligning ridge and each corresponding spacer member may have an aligning groove engagable with a corresponding ridge to facilitate placement of the spacer members in the receiving area.

Switching means are provided for selectively switching the extent to which the safety plate member may be depressed to thereby vary the number of perforations made in the cigarettes. The switching means includes a switch protrusion locatable at a first position at which the switch protrusion does not engage with a post disposed on the back side of the safety plate member and locatable at a second position at which the switch protrusion does engage with the post so that the relative position of the cigarettes to the piercing needles may be altered depending on the first and second switch positions to effect multiple perforation of the cigarettes contained in the receiving area. Also, the switching means includes a straight guide groove for guiding the switch protrusion between the first and second positions and switch locking means for locking the switch protrusion at the first and second positions. An improved switch pad is also provided which is operable by a user for selectively switching the switch protrusion to the first and second positions, wherein the switch pad has raised ridges to facilitate gripping.

DETAILED DESCRIPTION OF THE INVENTION

Figure 1:
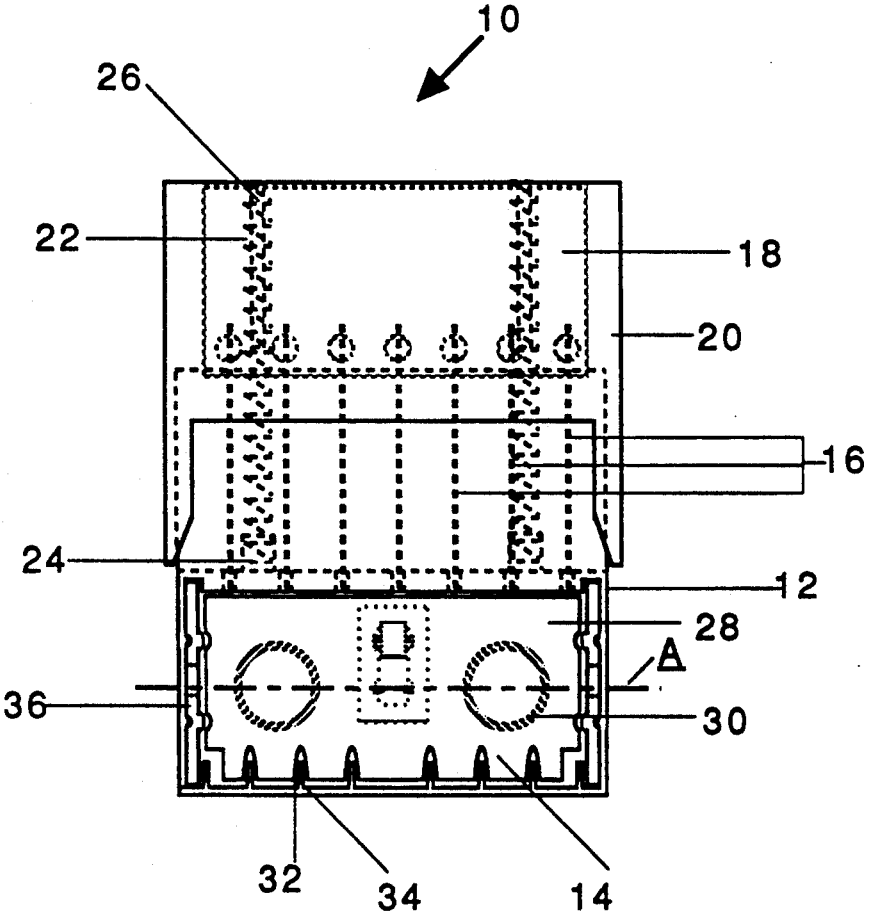
FIG. 1 is a front view of the inventive device for perforating packaged cigarettes.

Referring to FIG. 1, a front view of the inventive device 10 for perforating packaged cigarettes is shown. In accordance with this embodiment, a first housing member 12 at least partly defines a receiving area 14 which has an opening for receiving a package of cigarettes into the receiving area 14. Piercing means are provided for piercing the cigarettes, the piercing means including piercing needles 16 supported by a support 18 fixed to a second housing member 20. The second housing member 20 is biased by springs 22 which are disposed and retained by spring receptacles 24 and posts 26. The second housing member 20 is slidable over the first housing member 12 so that the piercing means may be moved relative to the first housing member 12 to cause the piercing needles 16 to pierce the cigarettes in the cigarette package (not shown) which is located in the receiving area 14.

A safety plate member 28 is disposed in the cigarette-receiving area 14 and positioned, configured and dimensioned to substantially cover the opening of the receiving area 14. The safety plate member 28 is slidable between a first or front position and a second or rear position. At the first position, the safety plate member 28 is effective to block the movement of the piercing needles 16 into the receiving area 14. The safety plate member 28 is also effective at the second position (the rear or depressed position) to allow insertion of the packaged cigarettes into the receiving area 14 and allow the piercing needles 16 to pierce the cigarettes when the second housing member 20 is slid against the bias of the springs 22 over the first housing member 12. Biasing means including at least two spring members 30 are provided in the housing member 12 for biasing the safety plate member 28 towards the first position. The spring members 30 have spring properties which are effective to allow steady and smooth movement of the safety plate member 28 between the first and second positions. In accordance with the present invention, the springs 30 are selected to have a diameter which is effective to promote steady and smooth movement of the safety plate member 28 between the first and second positions. The springs 30 preferably have a diameter of at least ½ inch and have a spring constant effective to promote the smooth movement of the safety plate member 28. The springs 30 are located along an imaginary longitudinal center axis A of the safety plate member 28 so as to apply a balanced biasing force to the safety plate member 28 to effectively prevent wobbling thereof while it moves and to prevent binding thereof against the sides of the receiving area 14. A set of grooves 32 are provided along the base of the safety plate member 28 and coact with a set of upstanding guides 34 to smoothly guide the movement of the safety plate member 28 between the first and second positions.

Furthermore, space altering means including spacer members 36 are disposed at opposite sides of the receiving area 14. These spacer members 36 may be selectively removed from the receiving area 14 so that cigarette packages of various sizes may be accommodated and inserted into the receiving area 14. Thus, in accordance with the present invention, a means is provided for perforating packaged cigarettes which are packaged in standard U.S. domestic packaging or alternatively packaged cigarettes which are packaged in different sized foreign packaging.

Referring to FIGS. 2*a* through 2*d*, the second housing member 20 is slidably engaged with the first housing member 12 and is biased in a direction away from the first housing member 12 by the springs 22. The piercing means, including the support 18 which holds the piercing needles 16, is fixed to the second housing member 20. A partition 38 is provided along wall of the receiving area 14 and has guide holes 40 for guiding the movement of the respective piercing needles 16. When the second housing member 20 is moved by a user against the bias of the springs 22 towards the first housing member 12, a second housing groove 42 (shown in FIG. 2*c*) and a first housing protrusion 44 coact to guide the relative movement of the second housing member 20 and first housing member 12. The first housing protrusion 44 also contacts with the edge of the second housing groove 42 to retain the second housing member 20 with the first housing member 12 and prevent the spring bias of the springs 22 from urging the second housing member 20 completely off of the first housing member 12.

The spacer members 36 are removable from the receiving area 14 and may be placed in the receiving area 14 by sliding the spacer members 36 into engaging grooves 46 provided at opposite sides of the receiving area 14. Thus, a space altering means is provided in the receiving area 14 for altering the size of the space defined by the receiving area 14 to accommodate variously sized cigarette packages. The two spacer members 36 are each disposed on and slidably attached at opposite sides of the receiving area 14. The opposite sides of the receiving area 14 each define the engaging groove 46 for slidably engaging a corresponding one of the spacer members 36. The opposite sides of the receiving area 14 may each have at least one aligning ridge 48' and each corresponding spacer member 36 may have an aligning groove 48 which is engageable with a corresponding aligning ridge 48' to facilitate the sliding movement of the space members 36 into the receiving area 14.

Figure 2A:
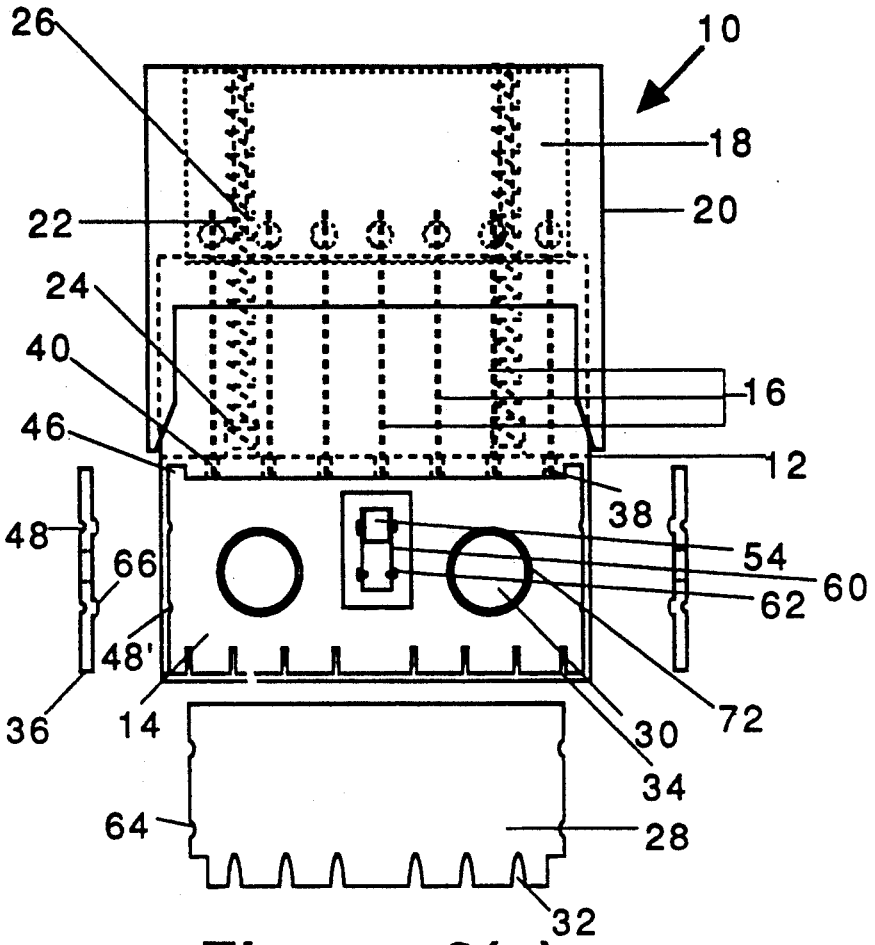
FIG. 2*a* is an exploded front view of the inventive device for perforating packaged cigarettes.
Figure 2B:
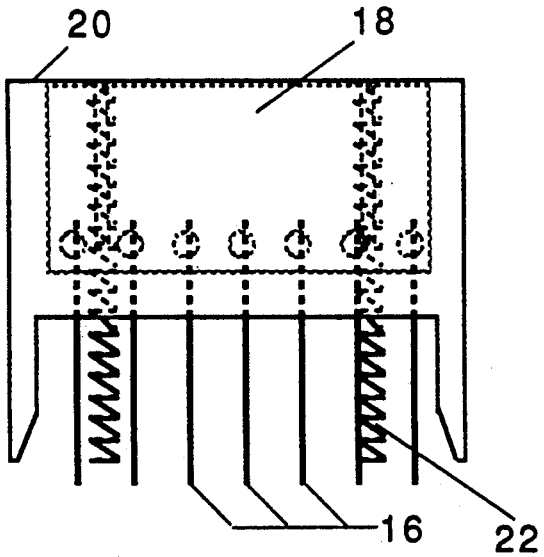
FIG. 2*b* is an isolated view of the second housing member and piercing means of the inventive device for perforating packaged cigarettes.
Figure 2C:
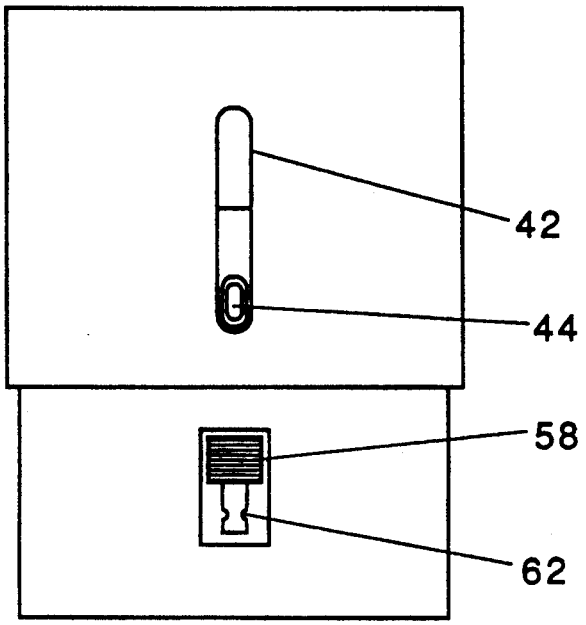
FIG. 2*c* is a rear view of the inventive device for perforating packaged cigarettes.
Figure 2D:
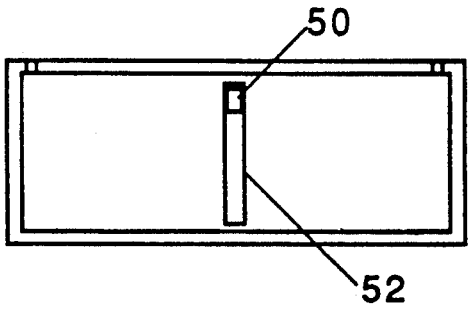
FIG. 2*d* is bottom view of the inventive device for perforating packaged cigarettes.

The safety plate member 28, as shown in FIG. 2*d*, has a safety plate member guide protrusion 50 which is slidably engaged with a guide groove 52 disposed at the bottom wall of the receiving area 14 opposite the wall having the guide holes 40. This guide protrusion 50 and guide groove 52 combination enhances the steady movement of the safety plate member 28 when being depressed by the insertion of a cigarette package into the receiving area 14 and also prevents the dislocation of the safety plate member 28.

Switching means are provided including a switch member in the form of a switch protrusion 54 for selectively switching the location at which the safety plate member 28 is maximumly depressed into the receiving area 14 by the insertion of the cigarette package. By selectively switching the location of maximum depression of the safety plate member 28, multiple perforation of the cigarettes in the cigarette package may be accomplished because the relative position of the cigarettes to the piercing needles 16 is dependent on the maximum depressed position of the safety plate member 28.

Figure 3A:
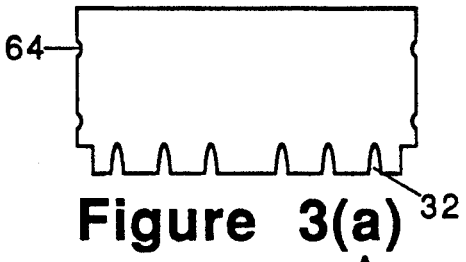
FIG. 3*a* is an isolated front view of the safety plate member of the inventive device for perforating packaged cigarettes.
Figure 3B:
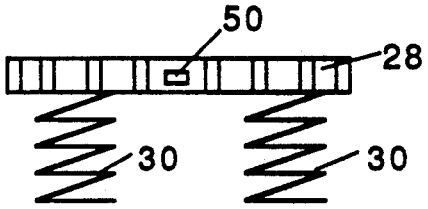
FIG. 3*b* is a bottom view of the safety plate member shown in FIG. 3*a* also showing spring members.
Figure 3C:
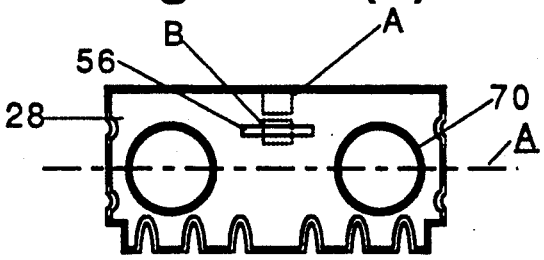
FIG. 3*c* is a rear view in FIG. 3*a*.
Figure 3D:
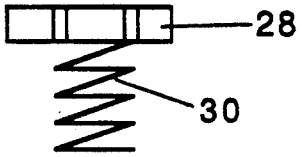
FIG. 3*d* is a side view of the safety plate member and springs shown in FIG. 3*b*.

The operation of the switching means will be described with reference to FIGS. 2*a* and 3*c*. As shown in FIG. 3*c*, the safety plate member 28 has a contact member in the form of an engaging post 56 disposed on its rear side. The engaging post 56 extends outwardly and rearwardly of the safety plate member 28 and is located over the switching means. In operation, the user may select a first position or a second position for the switch protrusion 54 by moving the switch pad 58 (shown in FIG. 2*c*) whose movement is guided by the straight guide groove 60. When the switch protrusion 54 is located at the first (upper) switch position A, the safety plate member 28 may be depressed to a maximum depth or location relative to the receiving area 14 and the cigarette package in the receiving area 14 will be at a particular position relative to the piercing needles 16, whereby the cigarettes in the cigarette package may receive a first perforation by moving the second housing member 20 relative to the first housing member 12 so that the piercing needles 16 pass through the cigarettes at a position of a first perforation. When the switch protrusion 54 is located at a second (lower) switch position B, which the user may accomplish by switching the switch pad 58 in the straight guide groove 60, the switch protrusion 54 is located directly behind and in the path of the engaging post 56 of the safety plate member 28. In this case, when the safety plate member 28 is depressed by the insertion of a cigarette package into the receiving area, the engaging post 56 contacts the switch protrusion 54 before the safety plate member 28 is depressed to the maximum depressing position and is stopped from further movement towards the maximum. Thus, the cigarette package is positioned in the receiving area 14 at a lesser depth so as to locate the cigarettes at a position different from the first described position so that a second perforation may be made at a different location along the length of the cigarette. In this manner, the switching means in cooperation with the contact member 56 connected to the rear of the safety plate member 28 constitute means for variably setting the depth of insertion of the cigarette package into the receiving area.

Thus, the cigarettes may receive multiple perforations to increase the reduction of nicotine and other toxins in the inhaled smoke from the cigarette. Also, the piercing needles 16 are located relative to the cigarette package so that if the cigarette package is inverted and reinserted in the receiving area 14, another perforation may be applied to the cigarettes at the sam relative height for each of the two positions of the switch protrusion 54. Thus, a total of four perforations may be made at different lengthwise locations in the cigarettes and the use can systematically and sequentially select from one to four perforations to sequentially reduce the percentage of nicotine and other toxins inhaled by the smoker.

Therefore, the present invetnion provides a means for systematically reducing the amount o nicotine inhaled per cigarette so that the smoker's body may be slowly weaned from the nicotine additction. The switching means also includes switch locking means including at least one switch lock bump 62 located on a stragiht guide groove 60 at each of the first and second positions which are effective to temporarily hold the switch protrusion 54 at the first and second positions. Also, the switch pad 58 may have raised ridges to facilitate gripping (shown) in FIG. 2*c*).

Referring to FIGS. 3*a* through 3*d*, a detailed explanation of the inventive safety plate member 28 will be described. The safety plate member 28 has bottom grooves 32 and side grooves 64 which engage with respective safety plate member guides 34 (shown in FIG. 2*a*) and guide ridges 66 to enhance the smoothness and steadiness of motion of the safety plate member 28. The springs 30 are retained by spring receptacles 70 disposed on the rear side of the safety plate member 28 and spring receptacles 72 (shown in FIG. 2*a*) idsposed on the back of the receiving area 14. The springs 30 are effective to promote steady and smooth movement of the safeyt plate member 28 when the safety plate is either depressed released. The springs 30 preferably have a diameter which is approximately ½ inch and a spring constant which is effective to promote smooth movement of the safety plate member. The springs 30 are located along an imaginary longitudinal center axis of the safety plate member 28 to minimize the tendency of the safety plate member 28 to wobble and bind against the walls of the receiving area 14 when it is being depressed or when the package of cigarettes is being removed and the safety plate member 28 returns to its original protective position. By virtue of the springs 30 engaging with the safety plate member 28 along the longitudinal center axis thereof, the biasing force exerted by the springs 30 is balanced, above and below the axis, to effect smooth movement of the safety plate member 28. Thus, the safety of the inventive device is enhanced by reducing the potential for the safety plate member 28 to become stuck in a depressed position when the cigarette package is removed, in which case, the piercing needles 16 would not be blocked by the safety plate member 28 and may inadvertently cause injury. Guide means comprised of the safety plate member guides 34 and front grooves 32 combination and the guide ridges 66 and side grooves 64 combination (shown in FIGS. 2*a*) are provided to further enhance the smooth motion of the safety plate member 28.

Figure 4A:
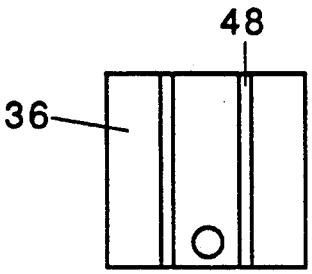
FIG. 4*a* is a side view of the outward side of a spacer member of the inventive device for perforating packaged cigarettes.
Figure 4B:
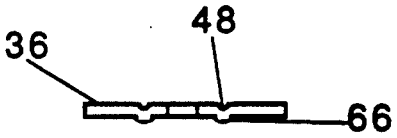
FIG. 4*b* is a front view of the spacer member shown in FIG. 4*a*.
Figure 4C:
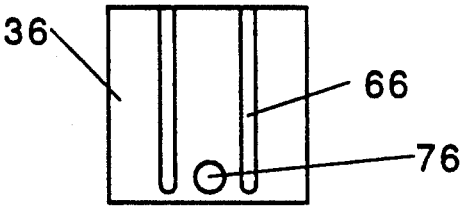
FIG. 4*c* is a side view of the inward side of the spacer member shown in FIG. 4*a*.
Figure 5A:
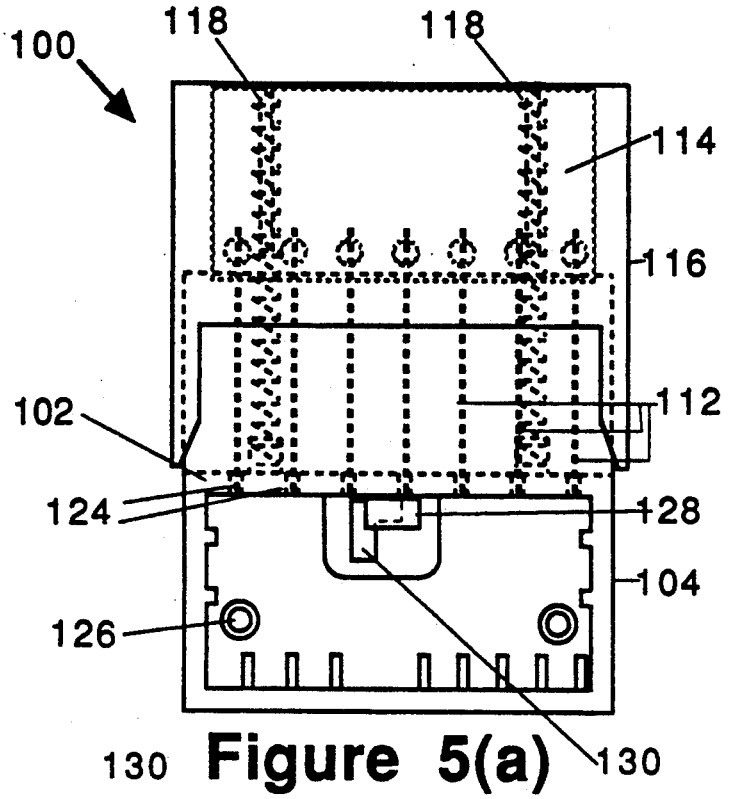
Figure 5(a) Prior Art
FIG. 5*a* is a front view of a prior art device for perforating packaged cigarettes without the safety plate member.
Figure 5B:
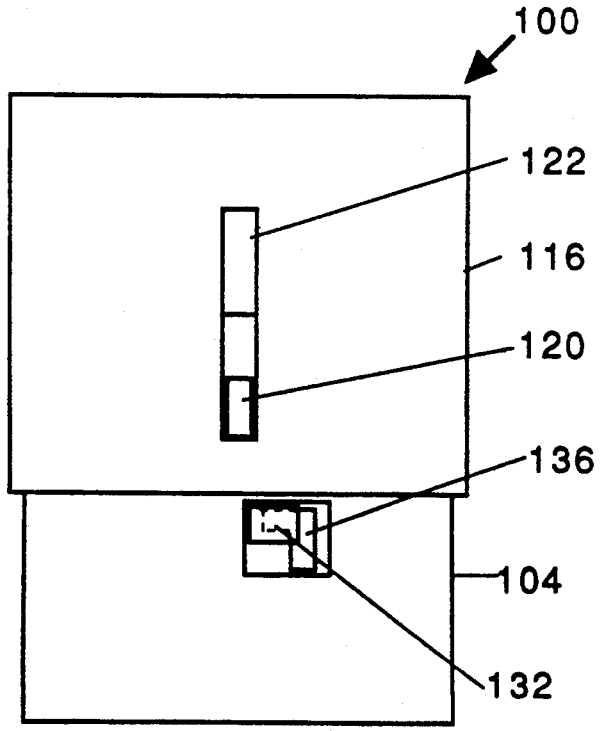
Figure 5(b) Prior Art
FIG. 5*b* is a rear view of the prior art device shown in FIG. 5*a*.
Figure 5C:
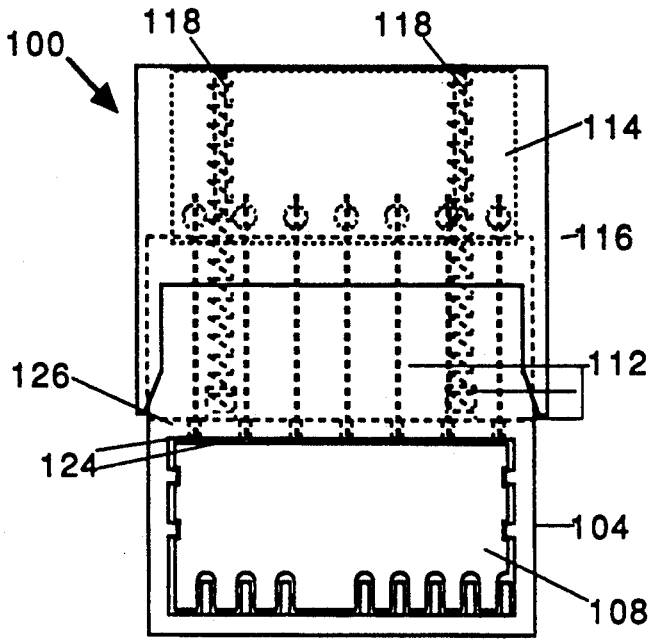
Figure 5(c) Prior Art
FIG. 5*c* is a front view of the prior art device shown in FIG. 5*a* with the prior art safety plate member.
Figure 5D:
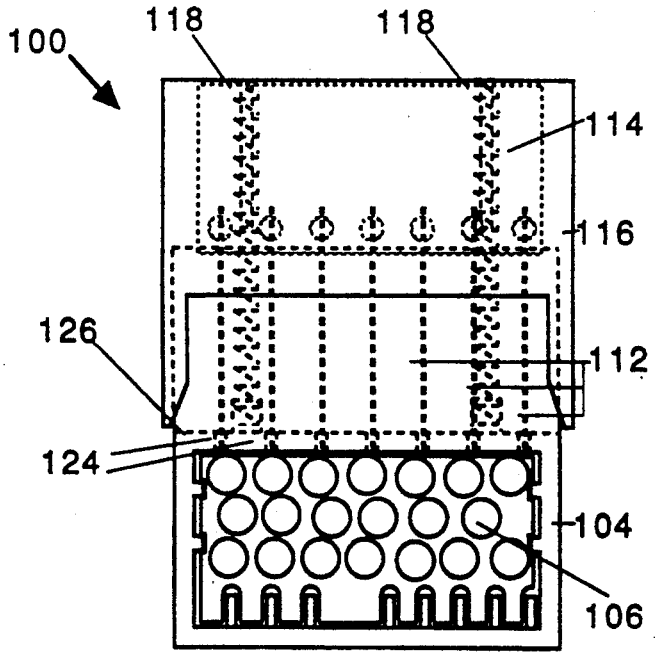
Figure 5(d) Prior Art
FIG. 5*d* is a front view of the prior art device shown in FIG. 5*a* showing cigarettes disposed in the receiving area.
Figure 5E:
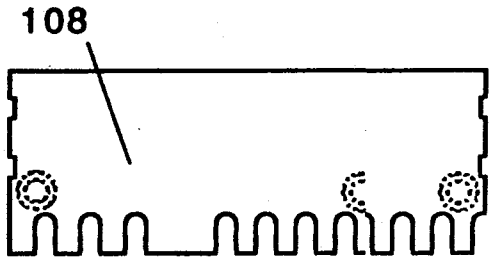
Figure 5(e) Prior Art
FIG. 5*e* is an isolated front view of the prior art safety plate member showing the location (dashed lines) of the spring members.
Figure 5F:
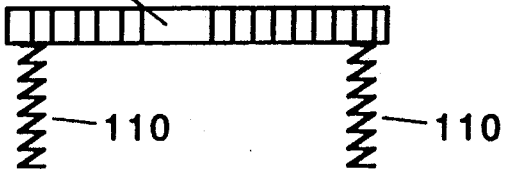
Figure 5(f) Prior Art
FIG. 5*f* is a bottom view of the prior art safety plate member shown in FIG. 5*e* also showing the spring members.
Figure 5G:
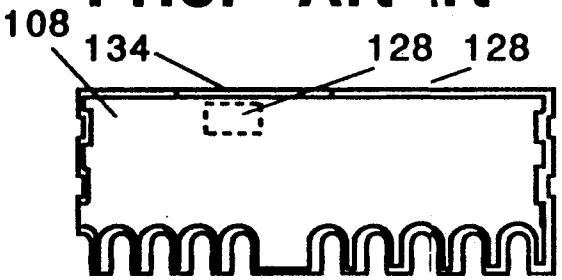
Figure 5(g) Prior Art
FIG. 5*g* is a rear view of the prior art safety plate member shown in FIG. 5*e* also showing the location of the switch protrusion at a second switch position.
Figure 5H:
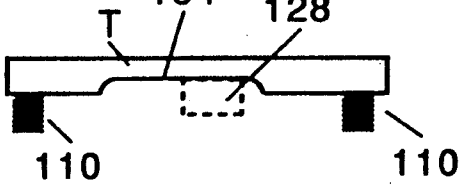
Figure 5(h) Prior Art
FIG. 5*h* is a top view of the prior art safety plate member shown in FIG. 5*e* also showing the spring members and the position of the switch protrusion at a first switch position.

Referring to FIGS. 4*a* through 4*c*, the spacer members 36 will be described. The spacer members 36 have a thickness such that when inserted in the receiving area 14, cigarette packages of varying sizes may be accommodated depending on whether one, two or no spacer member 36 is inserted therein. The spacer members 36 have aligning grooves 48 which act with aligning ridges 48' disposed on the receiving area 14 walls (shown in FIG. 2*a*) to facilitate the insertion of the spacer members 36. The spacer members 36 also have guide ridges 66 which coact with the side grooves 64 of the safety plate member 28 to facilitate the steady and smooth motion of the safety plate member 28. Furthermore, the spacer members 36 include grip-facilitating through holes 76 to facilitate the insertion and removal of the spacer members 36 into and from the receiving area 14.

With respect to the above description, it is realized that the optimum dimensional relationships for parts of the invention, including variations in size, materials, shape, form, function and manner of operation, assembly and use, are deemed readily apparent and obvious to one skilled in the art. All equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to, falling within the scope of the invention as defined in the claims.

I claim:

1. A device for perforating packaged cigarettes, comprising:

a first housing member at least partially defining a receiving area having an opening for receiving a package of cigarettes into the receiving area;

piercing means having a plurality of piercing needles, the piercing means being movable relative to the first housing member to cause the piercing needles to pierce the cigarettes in the cigarette package;

a safety plate member disposed in the receiving area and positioned, configured and dimensioned to substantially cover the opening of the receiving area, the safety plate member being effective at a first position to block the movement of the piercing means and the safety plate member being effective at a second position to allow the package of cigarettes into the receiving area and allow the piercing needles to pierce the cigarettes in the cigarette package; and two spring members for biasing the safety plate member towards the first position, said spring members being disposed along an imaginary center line of the safety plate member to effect smooth movement of the safety plate member between the first and second positions.

2. A device for perforating packaged cigarettes according to claim 1; wherein the spring members have a diameter effective to promote steady and smooth movement of the safety plate between the first and second positions.

3. A device for perforating package cigarettes according to claim 2; wherein the diameter of the spring member is approximately one half inch.

4. A device for perforating packaged cigarettes according to claim 1; wherein the spring members have a spring constant effective to promote smooth movement of the safety plate between the first and second positions.

5. A device for perforating packaged cigarettes according to claim 1; wherein the spring members are positioned along a central longitudinal axis of the safety plate member.

6. A device for perforating packaged cigarettes, comprising:

a first housing member at least partially defining a receiving area having an opening for receiving a package of cigarettes into the receiving area;

piercing means having a plurality of piercing needles, the piercing means being movable relative to the first housing member to cause the piercing needles to pierce the cigarettes in the cigarette package;

a safety plate member disposed in the receiving area and positioned, configured and dimensioned to substantially cover the opening of the receiving area, the safety plate member being effective at a first position to block the movement of the piercing means and the safety plate member being effective at a second position to allow the package of cigarettes into the receiving area and allow the piercing needles to pierce the cigarettes in the cigarette package; and space altering means including at least one spacer member removably disposed in the receiving area for altering the space defined by the receiving area to accommodate various sized cigarette packages.

7. A device for perforating packaged cigarettes according to claim 6; wherein the space altering means includes two spacer members each removably disposed at opposite sides of the receiving area.

8. A device for perforating packaged cigarettes according to claim 7; wherein the opposite sides of the receiving area each define a groove for slidably receiving a corresponding one of the spacer members.

9. A device for perforating packaged cigarettes according to claim 7; wherein the opposite sides of the receiving area each has at least one aligning ridge and each corresponding spacer member has an aligning groove engagable with a corresponding aligning ridge.

10. A device for perforating packaged cigarettes, comprising:

a first housing member at least partially defining a receiving area having an opening for receiving package of cigarettes into the receiving area;

piercing means having a plurality of piercing needles, the piercing means being movable relative to the first housing member to cause the piercing needles to pierce the cigarettes in the cigarette package;

a safety plate member disposed in the receiving area and positioned, configured and dimensioned to substantially cover the opening of the receiving area, the safety plate member being effective at a first position to block the movement of the piercing means and the safety plate member being effective at a second position to allow the package of cigarettes into the receiving area and allow the piercing needles to pierce the cigarettes in the cigarette package, and the safety plate member having an engaging post disposed thereon; and switching means for selectively switching the location of the second position for allowing the cigarettes in the cigarette package to be pierced at multiple locations on the cigarette, the switching means including a switch protrusion locatable at a first switch position at which the switch protrusion does not engage the engaging post and locatable at a second switch position at which the switch protrusion does engage the engaging post, and means defining a straight guide groove for guiding the switch protrusion between the first and second positions.

11. A device for perforating packaged cigarettes according to claim 10; wherein the switching means includes switch locking means operable for locking the switch protrusion at the first and second switch positions.

12. A device for perforating packaged cigarettes according to claim 11; wherein the switch locking means includes at least one switch lock bump located on the straight guide groove at each of the first and second switch positions and effective to temporarily hold the switch protrusion at the first and second positions.

13. A device for perforating packaged cigarettes according to claim 12; wherein the switch means includes a switch pad operable by a user for selectively switching the switch protrusion to the first and second positions, the switch pad having raised ridges to facilitate gripping.

14. A device for perforating package cigarettes according to claim 10; including biasing means for normally biasing the safety plate member towards the first position.

15. A device for perforating packaged cigarettes according to claim 14; wherein the biasing means comprises two spring members engaging with the safety plate member at locations spaced from one another along an imaginary center line of the safety plate member.

16. A device for perforating packaged cigarettes according to claim 10; including means for altering the size of the receiving area to enable the same to accommodate cigarette packages of different sizes.

17. A device for perforating packaged cigarettes according to claim 16; wherein the means for altering comprises at least one spacer member removably inserted in the receiving area to alter the size thereof.

18. A device for perforating packaged cigarettes, comprising: a housing at least partially defining a receiving area having an opening for receiving a package of cigarettes inserted into the receiving area; piercing means manually movable relative to the housing for piercing simultaneously all the cigarettes in a cigarette package inserted into the receiving area; safety means movably mounted on the housing and movable to a first position for blocking piercing movement of the piercing means and movable to a second position for permitting piercing movement of the piercing means; and setting means for variably setting the depth to which the cigarette package can be inserted into the receiving area to enable the piercing means to pierce the cigarettes at different locations along the lengths thereof, the setting means including switching means displaceable along a straight line between two witch positions to thereby set two different depths of insertion of the cigarette package into the receiving area.

19. A device according to claim 18; wherein the setting means includes a contact member movable in accordance with the insertion of the cigarette package into the receiving area; and the switching means includes a switch member displaceable in a straight line in accordance with the displacement o the switching means to engage with the contact member when the switching means is at one switch position and to not engage with the contact member when the switching means is at the other switch position.

20. A device according to claim 19; wherein the contact member comprises a protrusion connected to the safety means for movement therewith.

21. A device according to claim 18; including biasing means for resiliently biasing the safety means forwardly toward the first position, the biasing means exerting a biasing force sufficient to normally maintain the safety means in the first position and permitting rearward movement of the safety means against the biasing force to the second position in response to manual insertion of the cigarette package through the opening into the receiving area.

22. A device according to claim 21; wherein the safety means comprises a safety plate member having a longitudinal center axis and being slidably mounted on the housing to undergo sliding movement between the first position wherein the safety plate member blocks piercing movement of the piercing means and the second position wherein the safety plate member permits piercing movement of the piercing means; and the biasing means is disposed in the receiving area and engages the rear of the safety plate member along the longitudinal center axis thereof to thereby exert a balanced biasing force on the safety plate member.

23. A device according to claim 22; wherein the biasing means comprises a pair of springs spaced apart from one another along the longitudinal center axis.

24. A device according to claim 22; including means for selectively altering the size of the receiving area to enable the same to accommodate cigarette packages of different sizes.

25. A device according to claim 24; wherein the means for selectively altering comprises at least one spacer member removably insertable into the receiving area along one side thereof.

26. A device according to claim 25; including two spacer members removably insertable into the receiving area along opposite sides thereof.

27. A device for perforating packaged cigarettes, comprising: a housing at least partially defining a receiving area having an opening for receiving a package of cigarettes inserted into the receiving area; piercing means manually movable relative to the housing for piercing simultaneously all the cigarettes in a cigarette package inserted into the receiving area; safety means having a longitudinal center axis and being movably mounted on the housing for preventing unwanted movement of the piercing means, the safety means being forwardly movable to a first position to block piercing movement of the piercing means and rearwardly movable to a second position to permit piercing movement of the piercing means; and biasing means engageable with the safety means along the longitudinal center axis thereof for exerting a balanced biasing force on the safety means to bias the same forwardly toward the first position.

28. A device according to claim 27; wherein the safety means comprises a safety plate member having a longitudinal center axis and being slidably mounted on the housing to undergo sliding movement between the first position wherein the safety plate member blocks piercing movement of the piercing means and the second position wherein the safety plate member permits piercing movement o the piercing means; and the biasing means is disposed in the receiving area and engages the rear of the safety plate member along the longitudinal center axis thereof to thereby exert a balanced biasing force on the safety plate member.

29. A device according to claim 27; wherein the biasing means comprises a pair of springs spaced apart from one another along the longitudinal center axis.

30. A device according to claim 27; including means for selectively altering the size of the receiving area to enable the same to accommodate cigarette packages of different sizes.

31. A device according to claim 30; wherein the means for selectively altering comprises at least one spacer member removably insertable into the receiving area along one side thereof.

32. A device according to claim 31; including two spacer members removably insertable into the receiving area along opposite sides thereof.

33. A device according to claim 27; including setting means for variably setting the depth to which the cigarette package can be inserted into the receiving area to enable the piercing means to pierce the cigarettes at different locations along the lengths thereof.

34. A device according to claim 33; wherein the setting means includes switching means displaceable along a straight line path between two positions to thereby set two different depths of insertion of the cigarette package into the receiving area.

35. A device according to claim 34; wherein the setting means includes a contact member movable in accordance with the insertion of the cigarette package into the receiving area; and the switching means includes a switch member displaceable in a straight line in accordance with the displacement of the switching means to engage with the contact member when the switching means is at one switch position and to not engage with contact member when the switching means is at the other switch position.

36. A device according to claim 34; wherein the contact member comprises a protrusion connected to the safety means for movement therewith.

37. A device according to claim 34; including locking means for releasably locking the switching means in each of its two positions.

* * * * *